United States Patent [19]

Raschle

[11] 3,983,686

[45] Oct. 5, 1976

[54] TWIST TUBE FOR FALSE-TWIST DEVICES

[75] Inventor: Josef Raschle, Butschwil, Switzerland

[73] Assignee: Heberlein & Company, Switzerland

[22] Filed: Oct. 28, 1975

[21] Appl. No.: 626,541

[30] Foreign Application Priority Data

Nov. 29, 1974 Switzerland ..... 15835/74

[52] U.S. Cl. ..... 57/77.3

[51] Int. Cl.[2] ..... D02G 1/06

[58] Field of Search ..... 57/77.3, 77.45, 157 TS

[56] References Cited

UNITED STATES PATENTS

| | | | |
|---|---|---|---|
| 2,777,276 | 1/1957 | Klein | 57/77.3 |
| 3,232,036 | 2/1966 | Scragg | 57/77.3 |
| 3,349,554 | 10/1967 | Boutonnet | 57/77.3 |
| 3,574,273 | 4/1971 | Hilbert | 57/77.3 |
| 3,759,025 | 9/1973 | Takai et al. | 57/77.3 |
| 3,778,991 | 12/1973 | Brummer | 57/77.3 |
| 3,842,581 | 10/1974 | Schedler | 57/77.3 |

FOREIGN PATENTS OR APPLICATIONS

| | | | |
|---|---|---|---|
| 1,477,791 | 4/1967 | France | 57/77.3 |
| 1,049,776 | 11/1966 | United Kingdom | 57/77.3 |

*Primary Examiner*—Donald E. Watkins

*Attorney, Agent, or Firm*—Larson, Taylor and Hinds

[57] ABSTRACT

A twist-tube for false-twist devices for texturing textile yarns is described in which the tube is provided with an enlargement, which may be at one end, formed with opposed grooves. A sapphire thread guide extends across the enlargement with its ends extending into and peripherally fitting in opposed terminal ends of the grooves. This enables a comparatively short pin to be used which is positively prevented from escaping laterally from the tube so that harmful effects of centrifugal force are avoided. The grooves may either locate the pin with its axis intersecting the tube axis or with its curved surface displaced by a fraction of the yarn thickness beyond the tube axis.

4 Claims, 3 Drawing Figures

TWIST TUBE FOR FALSE-TWIST DEVICES

FIELD OF THE INVENTION

The present invention relates to twist tubes for false-twist devices for texturing textile yarns.

DESCRIPTION OF THE PRIOR ART

Twist tubes for false-twist devices are known which comprise, at one end of the twist tube or in the middle thereof, a part which is enlarged with respect to the diameter of the twist tube, in the interior of which there is arranged a transverse thread-guide pin, the yarn to be textured which passes through the longitudinal bore of the twist tube being wrapped once around the pin. The pin consists of hard material, for example sapphire or ceramic material and is fixed in corresponding transverse bores provided in opposite sides of the enlarged portion by means of adhesive material. This method of fixation has been sufficient to cover the requirements for a long time.

The development of false-twist devices for texturing textile yarns tends however to achieve higher and higher revolution speeds of the twist tube, so as to increase the production quantity of textured yarn. With the revolution speeds of up to 1 million r.p.m. required nowadays, the known fixation of the thread-guide pin is entirely insufficient. Thus, for example, with a sapphire pin of a length of 3,8 mm and a diameter of 0.7 mm in the middle of the pin, the centrifugal forces arising at a revolution speed of 1 million r.p.m. produce a force of approximately 16 kp/mm$^2$ (kiloponds per square millimeter) which tends to pull the pin into two halves. If an adhesive based on an epoxy resin is used, its elasticity, is approximately 110 times higher than that of sapphire, and under the effect of the high centrifugal forces, therefore, the major part of the above-mentioned tensile force acts on the pin so that there exists considerable danger of breakage of the pin. Because of the vibrations which furthermore appear in the twist tube at high revolution speeds, it is also possible that the adhesive fixation of the pin may be destroyed so that the pin slides longitudinally out of the transverse bores and is projected away from the twist tube.

It is the purpose of the present invention to eliminate these disadvantages and to provide a twist tube which assures, even under the effect of centrifugal force appearing at extremely high revolution speeds, permanent and safe fixation as well as break resistance of the thread-guide pin.

Accordingly, the object of the present invention consists in a twist tube with a transverse pin situated in the interior of an enlarged portion of the tube, the inner wall of the enlarged portion comprising two diametrically opposed grooves with which the extremities of the thread-guide pin are in form-closed engagement, that is to say they fit into the ends of the grooves precisely.

Contrary to the known twist tubes in which the enlarged part comprises, at diametrally opposed locations transversal bores passing through the tube, through which the pin may escape under the action of the high centrifugal force after the adhesive function has been destroyed, in the twist tube according to the present invention, the thread-guide pin is rigidly supported on both sides of the enlarged portion and accordingly safely secured against the action of the centrifugal force. Furthermore, in the embodiment of the twist tube according to the present invention, the thread-guide pin is essentially shorter than in the known twist-tubes. This is an advantage insofar as, for example with a reduced length of 2, 3 mm, the tensile forces acting on the middle of the pin in both directions along the axis of the pin only amount to approximately 5, 5 kp/mm$^2$. Accordingly, in spite of the existence of a gap of minimum thickness containing adhesive between the pin extremities and the wall portions of the enlarged twist tube portion, which support the pin, the danger of breakage of the sapphire pin is extremely small.

In order that the invention may be clearly understood and readily carried into effect, examples thereof will now be described, by way of example, with reference to the accompanying drawings, in which.

Figure 1:
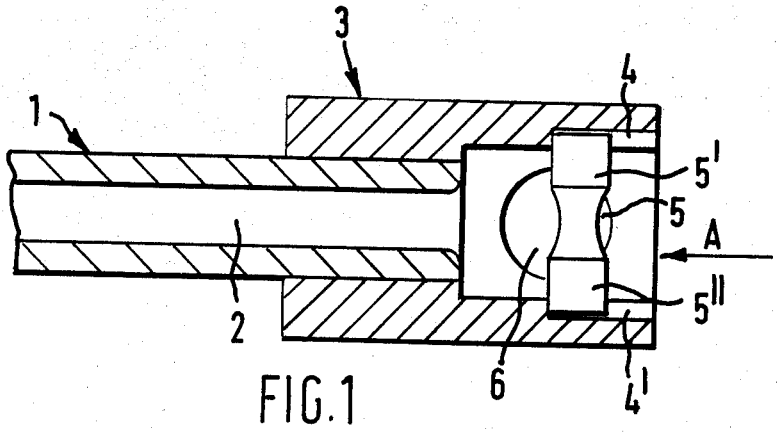
FIG. 1 shows a central longitudinal section through a portion of a twist tube.

The twist tube shown in FIG. 1 includes a steel tube 1 and an enlarged head 3 of aluminium which is fixed on the end of the tube 1. The steel tube 1 has an outer diameter of 2 mm and a longitudinal bore 2 of an inner diameter of 1 mm. The enlarged head 3 has an outer diameter of 4 mm and an inner diameter of 2,5 mm. The inner wall of head 3 comprises two diametrally opposite grooves 4, 4′ of a width of approximately 1 mm and depth of 0,25 mm into which the two ends 5′, 5″ of a thread guide pin 5 project. The pin 5 consists of sapphire, and its ends 5′, 5″ have a diameter of 1 mm whereas the minimum diameter of the central, recessed portion of the pin is approximately 0,7 mm. The thread-guide pin 5 is fixed in the grooves 4, 4′ by means of adhesive applied at the ends of the pin.

Figure 3:
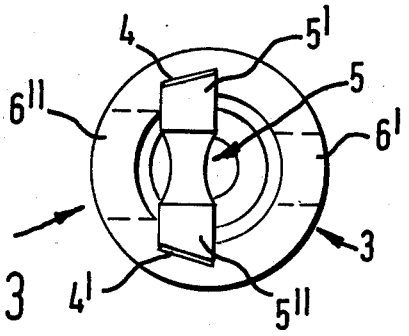
FIG. 3 shows a view analogous to that of FIG. 2 of a modified form of the twist tube.

In the modified form of the twist tube shown in FIG. 3, the thread-guide pin 5 is displaced with respect to the central axis of the head 3 by approximately half its thickness in the middle of the pin so that the circumference of the tapered portion of pin 5 over which the textile yarn passes only has a distance of the order of half the thickness of the yarn from the central longitudinal axis of the twist tube. The bases of the grooves 4, 4′ extend obliquely with respect to the longitudinal axis of pin 5, and the ends 5′, 5″ of the latter are therefore chamfered accordingly.

Figure 2:
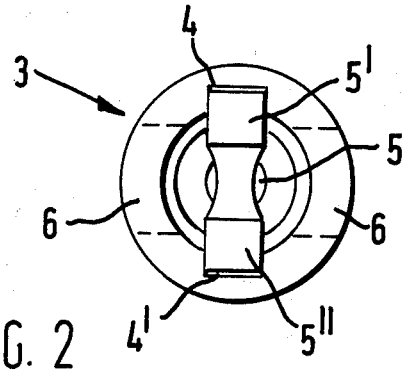
FIG. 2 shows a view of the twist tube in the direction of arrow A in FIG. 1.

As shown in FIGS. 1 – 3, the head 3 furthermore comprises a passage 6 transverse to the pin 5 and displaced with respect to the pin 5 in the direction of the longitudinal axis of the twist tube, which facilitates the threading of the yarn through the twist tube and wrapping it once round the pin. In order to compensate the excentricity due to excentric arrangement of the pin 5 in the embodiment of FIG. 3, the bore 6 has different diameters 6′, 6″ in the two opposite wall portions of head 3.

I Claim:

1. A twist tube for a false-twist device for texturing textile yarns comprising a tubular member having a bore for the passage therethrough of textile yarns and formed along its length with an enlarged portion, opposed longitudinal grooves being formed in said enlarged portion of said bore and having opposed terminal ends within said tubular member, a thread-guide pin extending across said bore and projecting at its ends into said grooves said pin being formed for yarn passing through said tube to be wrapped thereover and said guide pin ends being shaped peripherally to fit precisely into said terminal ends of said grooves and means for securing said pin in said grooves.

2. A twist tube for a false-twist device for texturing textile yarns comprising a tube having a bore therethrough, a head member forming a continuation of one end of said tube and formed with a bore constituting a continuation of said first-mentioned bore and forming therewith a through passage for textile yarns, said head member being formed on the inner surface thereof with opposed grooves extending longitudinally from the end of said head member remote from said tube to terminal ends within said head member, a thread-guide pin extending across said bore in said head member and projecting at its ends into said grooves, said pin being formed for yarn passing through said tube to be wrapped thereover and said ends of said pin being shaped peripherally to fit precisely into said terminal ends of said grooves, and adhesive means for securing said pin in said grooves.

3. A twist tube according to claim 1, wherein said grooves are located for a central longitudinal axis of said pin to intersect a central longitudinal axis of said bore.

4. A twist tube according to claim 1, wherein said grooves are located for said pin to be placed with respect to a central longitudinal axis of said bore in a position where said axis passes close to the surface of said pin.

* * * * *

UNITED STATES PATENT OFFICE

CERTIFICATE OF CORRECTION

Patent No. 3,983,686 Dated October 5, 1976

Inventor(s) Josef Raschle

It is certified that error appears in the above-identified patent and that said Letters Patent are hereby corrected as shown below:

Cover sheet, change the name of the assignee to:

--HEBERLEIN & CO. AG--.

Signed and Sealed this

Twenty-fifth Day of January 1977

[SEAL]

*Attest:*

RUTH C. MASON
*Attesting Officer*

C. MARSHALL DANN
*Commissioner of Patents and Trademarks*